US010365613B2

(12) United States Patent
Orny et al.

(10) Patent No.: US 10,365,613 B2
(45) Date of Patent: Jul. 30, 2019

(54) POSITIONING MECHANISM FOR A TOOTHED WHEEL IN A WATCH MOVEMENT

(71) Applicant: Harry Winston SA, Plan-les-Ouates (CH)

(72) Inventors: Franck Orny, La Chaux-de-Fonds (CH); Johnny Girardin, Fontaines (CH)

(73) Assignee: Harry Winston SA, Plan-les-Ouates (CH)

( * ) Notice: Subject to any disclaimer, the term of this patent is extended or adjusted under 35 U.S.C. 154(b) by 0 days.

(21) Appl. No.: 15/758,959

(22) PCT Filed: Sep. 22, 2016

(86) PCT No.: PCT/EP2016/072528
§ 371 (c)(1),
(2) Date: Mar. 9, 2018

(87) PCT Pub. No.: WO2017/050888
PCT Pub. Date: Mar. 30, 2017

(65) Prior Publication Data

US 2018/0246470 A1 Aug. 30, 2018

(30) Foreign Application Priority Data

Sep. 24, 2015 (EP) ..... 15186692

(51) Int. Cl.
*G04B 13/02* (2006.01)
*G04B 11/04* (2006.01)
*G04B 35/00* (2006.01)

(52) U.S. Cl.
CPC ..... *G04B 35/00* (2013.01); *G04B 11/04* (2013.01); *G04B 13/02* (2013.01)

(58) Field of Classification Search
CPC ..... G04F 7/08; G04F 7/0819; G04F 7/0814; G04F 7/0804; G04F 7/0809; G04B 35/00; G04B 13/02; G04B 11/04
See application file for complete search history.

(56) References Cited

U.S. PATENT DOCUMENTS 3,701,250 A * 10/1972 Ono ..... G04D 7/04 368/103
3,708,973 A * 1/1973 Funaki ..... G04C 17/0075 200/38 R (Continued)

FOREIGN PATENT DOCUMENTS

CH 227 300 A 5/1943
CH 271 999 A 11/1950

(Continued)

OTHER PUBLICATIONS

International Search Report dated Dec. 6, 2016 in PCT EP2016/072528 filed Sep. 22, 2016.

*Primary Examiner* — Sean P Kayes
(74) *Attorney, Agent, or Firm* — Oblon, McClelland, Maier & Neustadt, L.L.P.

(57) ABSTRACT

A positioning mechanism for a toothed wheel mounted on a rotatable staff in a watch movement, the positioning mechanism including a positioning lever exhibiting a flat lateral edge configured to cooperate with at least one flat provided on the staff of the toothed wheel. The positioning lever includes a pivot arm mounted in a pivotable manner about a pivot pin provided in the watch movement, a positioning element exhibiting the flat lateral edge and mounted in an articulated manner on the pivot arm, and a mechanism adjusting and locking the position of the positioning element on the pivot arm in relation to the staff of the toothed wheel.

6 Claims, 3 Drawing Sheets

(56) References Cited

U.S. PATENT DOCUMENTS

| | | | | |
|---|---|---|---|---|
| 5,113,382 | A * | 5/1992 | Bron | G04F 7/0814 368/106 |
| 5,793,708 | A | 8/1998 | Schmidt et al. | |
| 7,614,782 | B2 * | 11/2009 | Hiraya | G04F 8/006 368/112 |
| 8,213,268 | B2 * | 7/2012 | Kato | G04C 3/143 368/112 |
| 2004/0037171 | A1 | 2/2004 | Meis | |
| 2007/0019509 | A1 * | 1/2007 | Gabathuler | G04F 7/0809 368/106 |
| 2007/0206447 | A1 | 9/2007 | Hiraya et al. | |
| 2008/0043576 | A1 * | 2/2008 | Scheufele | G04F 7/08 368/106 |
| 2009/0161493 | A1 * | 6/2009 | Wyssbrod | G04F 7/0804 368/106 |
| 2011/0216633 | A1 * | 9/2011 | Pesenti | G04B 9/02 368/244 |
| 2012/0082010 | A1 * | 4/2012 | Boulenguiez | G04B 17/066 368/184 |
| 2016/0246256 | A1 * | 8/2016 | Zaugg | G04F 7/0895 |
| 2016/0282815 | A1 * | 9/2016 | Orny | G04B 19/202 |

FOREIGN PATENT DOCUMENTS

| | | | |
|---|---|---|---|
| EP | 0 772 104 | A1 | 5/1997 |
| WO | 03/009068 | A1 | 1/2003 |
| WO | 2014/076262 | A1 | 5/2014 |

* cited by examiner

POSITIONING MECHANISM FOR A TOOTHED WHEEL IN A WATCH MOVEMENT

CROSS-REFERENCE TO RELATED APPLICATIONS

This is a National phase Application in the United States of International Patent Application PCT/EP2016/072528 filed on Sep. 22, 2016 which claims priority on European patent application No. 15186692.8 filed on Sep. 24, 2015. The entire disclosure of the above patent applications are hereby incorporated by reference.

FIELD OF THE INVENTION

The invention relates to the field of mechanical watchmaking. It concerns, more particularly, a positioning mechanism for a toothed wheel mounted on a rotatable staff in a watch movement, said positioning mechanism comprising a positioning lever exhibiting a flat lateral edge so arranged as to cooperate with a flat provided on the staff of the toothed wheel. The present invention likewise concerns a watch movement comprising a suchlike positioning mechanism.

BACKGROUND TO THE INVENTION

A suchlike positioning mechanism is described in application WO 2014/076262, for example. Said earlier document is incorporated by reference. Said mechanism comprises a positioning lever 101 exhibiting a flat lateral edge so arranged as to cooperate with a flat 97 provided on the staff of the pinions 96, 98, 100 and is utilized to pivot and reposition the pinions 96, 98, 100 perfectly when the displacement cycle of the information carrier is completed.

However, said mechanism does not permit the fine adjustment of the positioning lever, which is frequently a requirement in the field of watchmaking. In particular, a suchlike mechanism does not make it possible to guarantee the initial positioning or the correct repositioning of a toothing intended to cooperate with another toothing for periods. As a result, the risks of engagement faults when starting or when restarting the toothed wheel following a temporary stop are considerable.

SUMMARY OF THE INVENTION

The invention has as its aim, inter alia, to address the shortcomings of the previously disclosed mechanism.

More particularly, one aim of the invention is to provide a positioning mechanism for a toothed wheel intended to cooperate with another toothed wheel for periods, said positioning mechanism permitting the fine adjustment of the positioning lever in order to guarantee the correct initial positioning of the toothed wheel or its repositioning, so as to ensure trouble-free engagement between said toothed wheels, in particular following a temporary stop of the toothed wheel.

For this purpose, the present invention concerns a positioning mechanism for a toothed wheel mounted on a rotatable staff in a watch movement, said positioning mechanism comprising a positioning lever exhibiting a flat lateral edge so arranged as to cooperate with at least one flat provided on the staff of the toothed wheel.

According to the invention, the positioning lever comprises a pivot arm so arranged as to be mounted in a pivotable manner about a pivot pin provided in the watch movement, a positioning element exhibiting the flat lateral edge and being mounted in an articulated manner on the pivot arm, and means for adjusting and locking the position of the positioning element on the pivot arm in relation to the staff of the toothed wheel.

The present invention likewise concerns a watch movement comprising a toothed wheel mounted on a rotatable staff and comprising a positioning mechanism as defined above.

The positioning mechanism according to the invention makes it possible to ensure the very fine adjustment of the positioning lever, in order to guarantee the correct positioning or repositioning of said toothed wheel, in particular following a temporary stop of said toothed wheel.

BRIEF DESCRIPTION OF THE DRAWINGS

Other characterizing features and advantages of the invention will emerge more clearly from a perusal of the following description of a particular embodiment of the invention, which is given by way of a simple illustrative and non-exhaustive example, and of the accompanying figures, in which.

DETAILED DESCRIPTION OF A PREFERRED EMBODIMENT

In the present description, the expression "toothed wheel" should be interpreted in the broad sense and designates any circular element comprising at least one toothed segment, such as a disc, a wheel, a crown, a pinion, etc.

Figure 1:
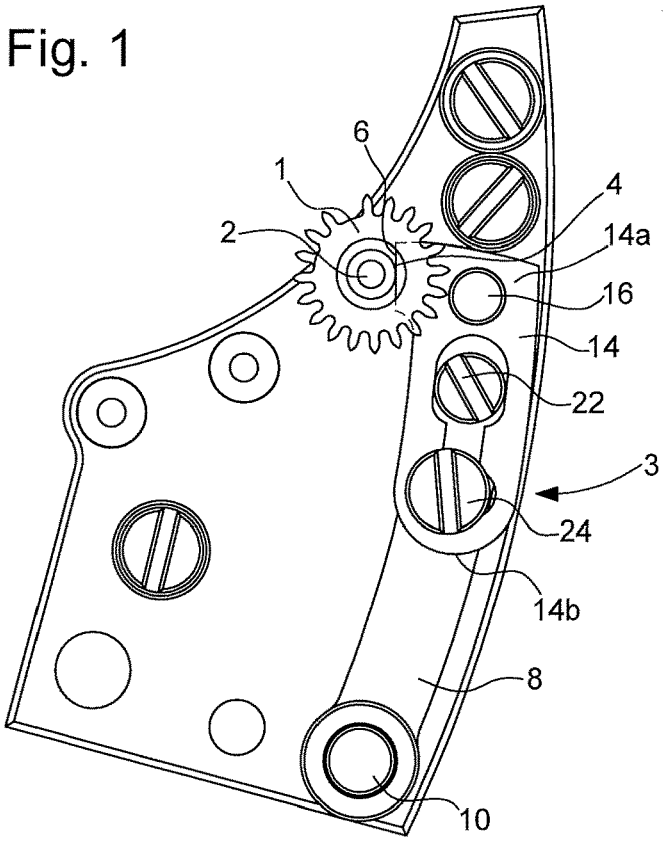
FIG. 1 represents a view from above of a positioning mechanism according to the invention.
Figure 2:
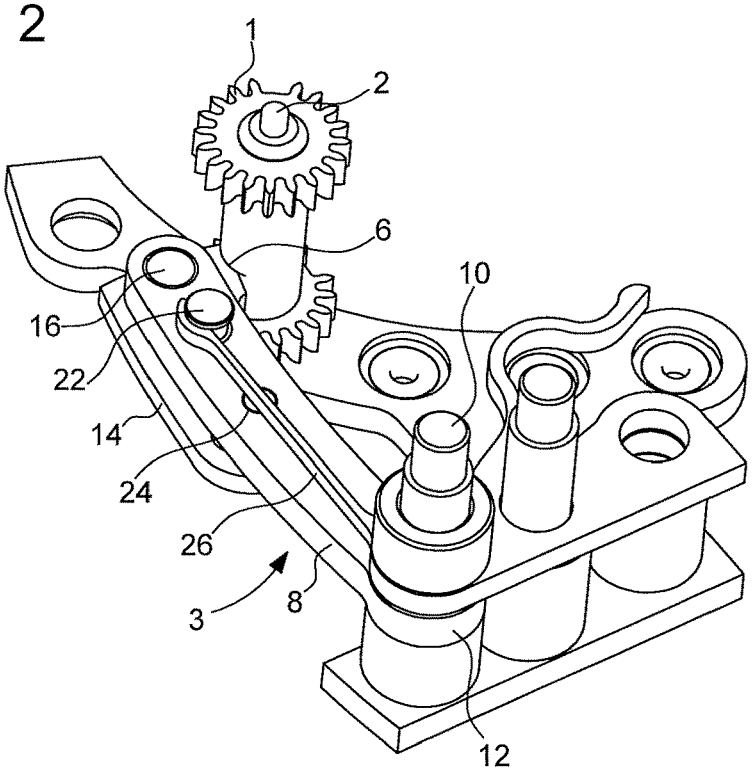
FIG. 2 is an isometric view from below of the mechanism in FIG. 1, FIGS. 3 and 4 are views from above of the positioning mechanism according to the invention in two different adjustment positions.

With reference to FIGS. 1 and 2, a positioning mechanism for a toothed wheel 1 mounted on a rotatable staff 2 in a watch movement is represented here. The toothed wheel 1 is so arranged as to cooperate with another toothing of a mechanism of the watch movement (not represented), more particularly per period or per cycle, the toothed wheel 1 coming to a standstill at the end of the period or of the cycle in its initial position or any other position determined by the mechanism. More particularly, the toothed wheel 1 corresponds, for example, to the reversing pinions 96-98 and 100 that are described in application WO 2014/176262 and are provided for causing the actuating wheel of the arm to rotate in the clockwise and anti-clockwise direction during its displacement cycle. Once the arm has performed a displacement cycle, the reversing pinions must return in a certain manner into their initial position in order to be able to engage faultlessly once more with the different toothings of the mechanism during the following cycle. In the rest of the description, the toothed wheel 1 corresponds to the reversing pinions 96-98 or 100 or any other toothed wheel of a watch mechanism requiring more particularly the highly accurate repositioning of the teeth when the toothed wheel stops after having pivoted through a determined angle.

A positioning lever 3 exhibiting a flat lateral edge 4 so arranged as to cooperate with a flat 6 provided on the staff 2 of the toothed wheel 4 is proposed in order to guarantee the correct positioning of the toothed wheel 1 following its stop. The flat 6 is realized on the staff 2 in such a way as to be positioned facing towards the lateral edge 4 of the positioning lever 3 when the toothed wheel 1 stops after having pivoted through the determined angle.

According to the invention, the positioning lever 3 comprises a pivot arm 8 so arranged as to be mounted in a pivotable manner about a pivot pin 10 provided in the watch movement. For this purpose, the pivot arm exhibits at one extremity a ring 12 mounted in a pivoting manner on the pivot pin 10. At its other extremity, this being its free extremity, the pivot arm 8 supports a positioning element 14 which exhibits the flat lateral edge 4. More particularly, the positioning element 14 is mounted superimposed on the pivot arm 8 in such a way as to exhibit an outer extremity 14*a* exhibiting the flat lateral edge 4 facing towards the staff 2 of the toothed wheel 1 and an inner extremity 14*b* facing towards the pivot pin 10 of the pivot arm 8. The positioning element 14 is mounted in an articulated manner on the pivot arm 8 via its outer extremity 14*a* by means of a pivot 16 provided at the free extremity of the pivot arm 8 and mounted cross-wise in the outer extremity 14*a* of the positioning element 14.

With reference more specifically to FIGS. 3 to 6, the positioning element 14 comprises between its outer extremity 14*a* and its inner extremity 14*b* a first elongate opening 18, disposed longitudinally in relation to the pivot arm 8, and a second elongate opening 20, disposed transversely in relation to the pivot arm 8. The first and second elongate openings 18, 20 are linked by a channel 23. The first opening 18 is so arranged as to cooperate with the means of adjusting the position of the positioning element 14, and the second opening 20 is so arranged as to cooperate with the means of locking the position of the positioning element 14.

Advantageously, the means for adjusting the position of the positioning element 14 on the pivot arm 8 in relation to the staff 2 of the toothed wheel 1 comprise an eccentric 22 mounted on the pivot arm 8 and so arranged as to cooperate with the positioning element 14. More particularly, the eccentric 22 is mounted on the pivot arm 8 by being accommodated in the first elongate opening 18 in such a way as to be able to cooperate with the edges of said elongate opening 18 in order to cause the positioning element 14 to pivot about the pivot 16 during adjustment.

Preferably, the means for locking the position of the positioning element 14 on the pivot arm 8 in relation to the staff 2 of the toothed wheel 1 comprise a clamping screw 24 mounted on the pivot arm 8 and so arranged as to secure the positioning element 14 on said pivot arm 8. More particularly, the clamping screw 24 is mounted on the pivot arm 8 through the second elongate opening 20 of the positioning element 14. The positioning element 14 is thus able to move around the clamping screw 24 when it is pivoted for the purpose of the adjustment.

A retaining spring 26 for the pivot arm is likewise proposed. As illustrated in FIG. 2, the retaining spring 26 is mounted on the pivot pin 10 and is hooked onto the eccentric 22 mounted on the pivot arm 8.

The operation of the positioning mechanism according to the invention is as follows: at the moment of the installation of the mechanism, the positioning element 14 is positioned in such a way that its flat lateral edge 4 is aligned with the flat 6 provided on the staff 2 of the toothed wheel 1 which faces towards the positioning element 14 when the toothed wheel 1 is in a position corresponding to its stopped position after having pivoted through the determined angle. The positioning element 14 presses against the flat 6 in order to reposition the toothed wheel 1 correctly so as to enable its toothing to engage faultlessly with the mechanism associated with the next restarting of the toothed wheel 1.

Figure 3:
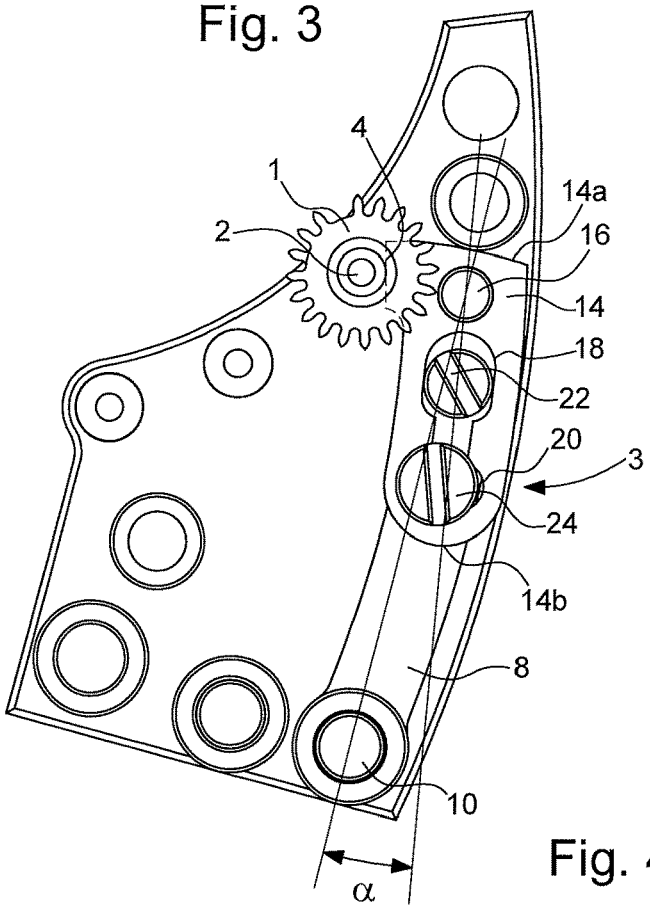
Figure 4:
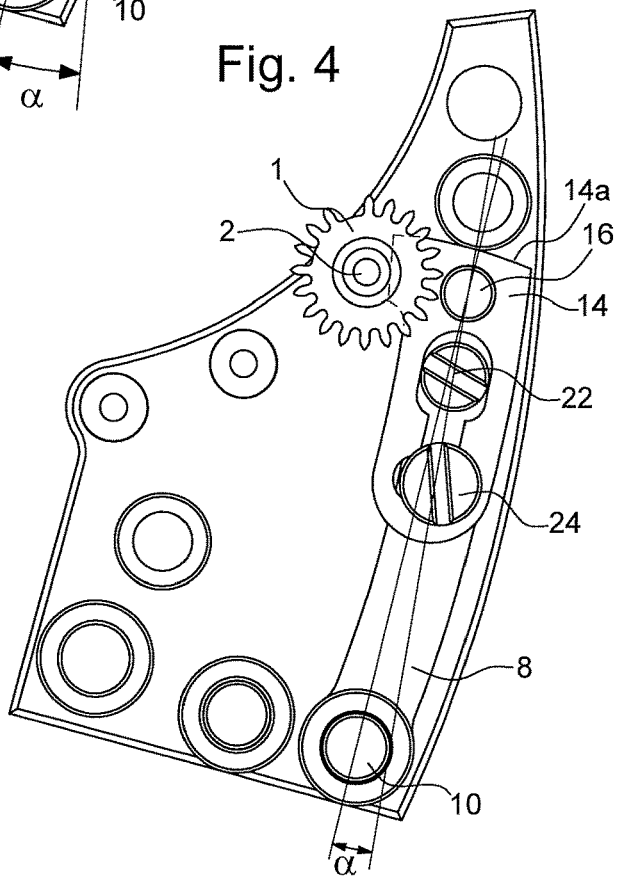

In order for the effect of the positioning lever 3 on the flat 6 to be as effective as possible, it is necessary for the flat lateral edge 4 to be perfectly aligned with the flat 6. The position of the positioning lever 3 must, therefore, be very finely adjusted. For this purpose, the positioning element 14 is pivoted about the pivot 16 by means of the eccentric 22 cooperating with the edges of the first elongate opening 18 in such a way as to modify the angular position $\alpha$ of the positioning element 14 to a greater or lesser extent in relation to the pivot arm 8, as represented in FIGS. 3 and 4. The second elongate opening 20 permits the displacement of the positioning element 14, while leaving the adjustment screw mounted on the pivot arm. Once the angular position $\alpha$ of the positioning element 14 has been adjusted in order for the flat lateral edge 4 to be perfectly aligned with the flat 6, the positioning element 14 is fixed on the pivot arm 8 by means of the clamping screw 24.

Figure 5:
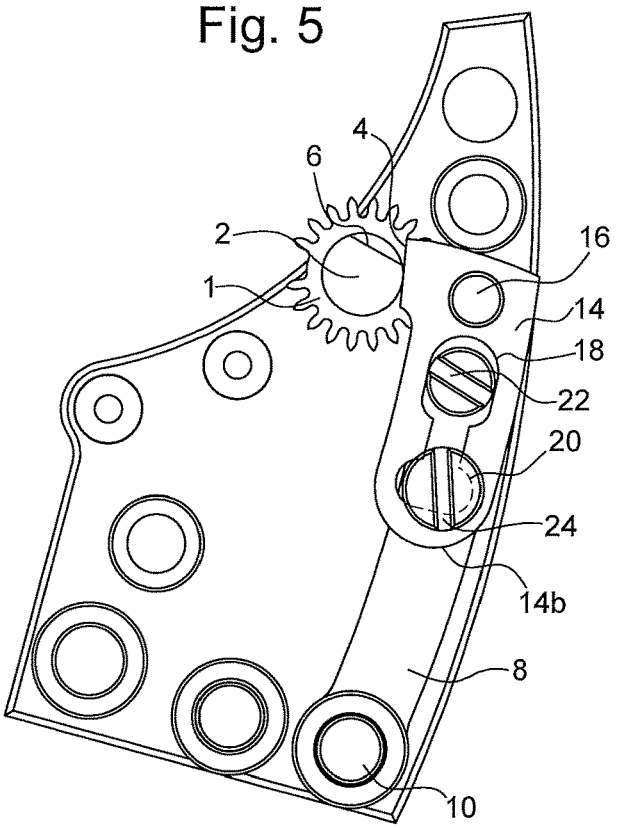
FIG. 5 is a view from above of the positioning mechanism according to the invention, the toothed wheel being in an operating position.
Figure 6:
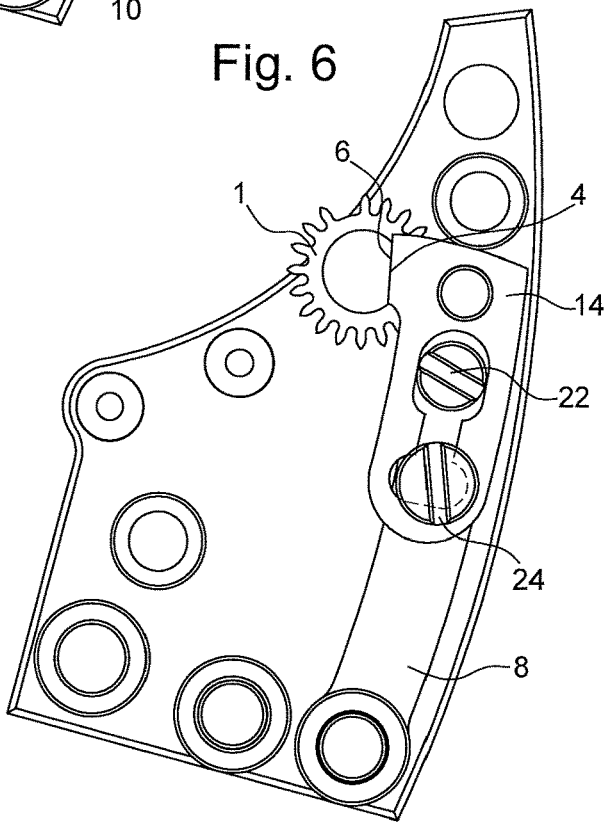
FIG. 6 is a view from above of the positioning mechanism according to the invention, the toothed wheel being in a stopped position.

With reference to FIG. 5, during operation of the mechanism, the positioning lever 3 is raised by the rounded face of the staff 2 of the toothed wheel 1. When the toothed wheel 1 has pivoted through the angle determined in relation to the position of the flat 6, the flat 6 arrives facing towards the pivot lever 3, which is lowered as it is returned by its retaining spring 26. When the toothed wheel 1 stops, the flat lateral edge 4 of the positioning element 14 then presses against the flat 6 of the staff 2 in order to reposition the toothing of the toothed wheel 1, as shown in FIG. 6. The alignment of the lateral edge 4 of the positioning element 14 with the flat 6 of the staff 2 obtained thanks to the very fine adjustment of the positioning element 14 permits the exact repositioning of the toothed wheel 1 in order for its toothing to be able to engage faultlessly with the mechanism associated with the next restart.

The invention claimed is:

1. A positioning mechanism for a toothed wheel mounted on a rotatable staff in a watch movement, the positioning mechanism comprising:

a positioning lever exhibiting a flat lateral edge arranged to cooperate with at least one flat provided on the staff of the toothed wheel, wherein the positioning lever comprises a pivot arm mounted in a pivotable manner about a pivot pin provided in the watch movement, the positioning lever further comprises a positioning element exhibiting the flat lateral edge and mounted to the pivot arm at a pivot point on an end opposite the pivot pin of the pivot arm and adjacent to the flat lateral edge, and an adjusting mechanism to adjust and a locking mechanism to lock a position of the positioning element on the pivot arm in relation to the staff of the toothed wheel, and the adjusting mechanism comprises an eccentric mounted on the pivot arm and arranged to cooperate with the positioning element, and a retaining spring mounted to the pivot pin and connecting to the eccentric.

2. The positioning mechanism according to claim 1, wherein the positioning element is mounted superimposed on the pivot arm to exhibit an outer extremity exhibiting the flat lateral edge facing towards the staff of the toothed wheel and an inner extremity facing towards the pivot pin of the pivot arm.

3. The positioning mechanism according to claim 2, wherein the positioning element is mounted in an articulated manner on the pivot arm via its outer extremity by a pivot provided on the pivot arm.

4. The mechanism according to claim 1, wherein the locking mechanism comprises a clamping screw mounted on the pivot arm and arranged to secure the positioning element on the pivot arm.

5. The positioning mechanism according to claim 1, wherein the positioning element comprises a first elongate opening arranged to cooperate with the adjusting mechanism and a second elongate opening arranged to cooperate with the locking mechanism.

6. A watch movement comprising:

a toothed wheel mounted on a rotatable staff comprising a positioning mechanism for the toothed wheel, the positioning mechanism comprising a positioning lever exhibiting a flat lateral edge arranged to cooperate with at least one flat provided on the staff of the toothed wheel, wherein the positioning lever comprises a pivot arm mounted in a pivotable manner about a pivot pin provided in the watch movement, the positioning lever further comprises a positioning element exhibiting the flat lateral edge and mounted to the pivot arm at a pivot point on an end opposite the pivot pin of the pivot arm and adjacent to the flat lateral edge, and an adjusting mechanism to adjust and a locking mechanism to lock a position of the positioning element on the pivot arm in relation to the staff of the toothed wheel, and the adjusting mechanism comprises an eccentric mounted on the pivot arm and arranged to cooperate with the positioning element, and a retaining spring mounted to the pivot pin and connecting to the eccentric.

* * * * *